US007089710B2

(12) United States Patent
Nicholson

(10) Patent No.: US 7,089,710 B2
(45) Date of Patent: Aug. 15, 2006

(54) PIPING CLAMP FOR CONCRETE FORM

(76) Inventor: Robert Nicholson, 2020 Briarwood Rd., Santa Maria, CA (US) 93455

( * ) Notice: Subject to any disclaimer, the term of this patent is extended or adjusted under 35 U.S.C. 154(b) by 6 days.

(21) Appl. No.: 10/626,474

(22) Filed: Jul. 23, 2003

(65) Prior Publication Data

US 2005/0016113 A1 Jan. 27, 2005

(51) Int. Cl.
*E04C 5/16* (2006.01)

(52) U.S. Cl. ..... 52/698; 52/677; 52/699; 248/68.1; 248/49

(58) Field of Classification Search ..... 52/698, 52/699, 677, 682, 684; 249/30, 91, 93, 219.1, 249/148; 248/68.1, 62, 49; 404/135, 136; 24/457

See application file for complete search history.

(56) References Cited

U.S. PATENT DOCUMENTS 271,733 A * 2/1883 Patee et al. ..... 248/539
332,383 A * 12/1885 Cole et al. ..... 248/539
693,213 A * 2/1902 Bajohr ..... 248/71
3,483,996 A * 12/1969 Scammon ..... 294/143
5,090,645 A * 2/1992 Zuercher ..... 248/68.1
5,125,619 A * 6/1992 Collins ..... 249/219.1
5,216,866 A * 6/1993 Ekedal ..... 52/677
5,688,428 A * 11/1997 Maguire ..... 249/91
6,047,515 A * 4/2000 Behlen ..... 52/699

* cited by examiner

*Primary Examiner*—Carl D. Friedman
*Assistant Examiner*—Chi Q. Nguyen
(74) *Attorney, Agent, or Firm*—Christie, Parker & Hale, LLP

(57) ABSTRACT

A piping clamp for holding a pipe to a concrete form. The piping clamp includes a base having a vertical standoff and a spring clamp extending horizontally from the base. The vertical standoff prevents the spring clamp from contacting the top surface of a poured concrete structure, thus allowing workers to trowel the concrete's surface without interfering with the clamp. In addition, a web portion of the spring clamp acts as a horizontal standoff and precludes a clamped piping run from coming into contact with the concrete form. The base may include a plurality of staggered fastener openings facilitating adjustment of the piping clamp during installation. In use, the spring clamp removably secures a piping run to a concrete form until the concrete form is removed. During removal, the spring clamp allows the piping run and the concrete form to be easily separated without disturbing the piping run.

14 Claims, 5 Drawing Sheets

PIPING CLAMP FOR CONCRETE FORM

BACKGROUND OF THE INVENTION

This invention pertains generally to building construction techniques and more specifically to clamps used to temporarily hold objects during a step in construction.

Modern building construction techniques rely on the coordination of specialized tradesmen capable of quickly entering a job site and performing a next step in a construction project. Each trade is responsible for its own layout, rough, and finish work stages which sometimes must be interleaved with the work stages of other trades. An example of this is the layout and roughing-in of piping for a building, usually a residential building, having a concrete slab foundation. As many of the services of the building, particularly Drain Waste and Vent (DWV) piping, must be routed underneath the building, these services must be laid-out and roughed-in before the concrete slab is poured and surfaced.

Since each trade is only on a job site during their respective work stages, the work of one trade may interfere with the work of another. For example, sometimes when a slab foundation is poured and surfaced, the process dislodges the roughed-in services of other trades. While usually not fatal to the overall project, a tradesman must sometimes expend additional efforts to correct a dislodged service after the slab foundation has cured. In addition, sometimes a tradesman's rough-in work interferes with the pouring of the slab. For example, if a vertical piping run is placed too close to a concrete form this prevents poured concrete from effectively filing the space between the piping run and the concrete form. Once the concrete form is removed, there may be an unsightly or even structurally significant defect in the unfinished side of the concrete slab.

To prevent such occurrences, tradesmen doing rough-in work around concrete forms typically use the concrete forms as anchoring surfaces to which the roughed-in services are temporarily tied. The methods of tying a roughed-in service to a concrete form are usually ad-hoc as the tradesmen use whatever materials may laying around to make the temporary connection to the concrete form. For example, for DWV services, the DWV piping is typically tied to the concrete form using a combination of nails and plumber's tape or wire. This method is not only time consuming, but may result in damage to the piping run when the concrete form is removed if the piping run is too tightly bound to the concrete form.

Therefore a need exists for a method to tie piping runs to concrete forms temporarily that is both efficient to install and reduces damage to a piping run when the concrete form is removed. Various aspects of the present invention meet such a need.

SUMMARY OF THE INVENTION

In one aspect of the invention, a piping clamp is provided for temporarily holding a piping run to a concrete form. The piping clamp includes a base having a vertical standoff and a spring clamp extending horizontally from the base. The vertical standoff prevents the spring clamp from contacting the top surface of a poured concrete structure, thus allowing workers to trowel the surface without interfering with the clamp. In addition, a web portion of the spring clamp acts as a horizontal standoff to prevent a clamped piping run from coming into contact with the concrete form. This allows concrete to flow completely around the piping run. In addition, the base may include a plurality of staggered fastener openings facilitating adjustment of the piping clamp during installation. In use, the spring clamp removably secures a piping run to a concrete form until the concrete form is removed. During removal, the spring clamp allows the piping run and the concrete form to be easily separated without disturbing the piping run.

In another aspect of the invention, a piping clamp for a concrete form has a base with an upper portion and a standoff portion and a spring clamp extending from the upper portion of the base.

In another aspect of the invention, the piping clamp for a concrete form further includes a top surface and a bottom surface and a plurality of fastener openings extending from the top surface to the bottom surface.

In another aspect of the invention, the base for the piping clamp for a concrete form further includes a front surface and a back surface, wherein the plurality of fastener openings are staggered in a spaced apart configuration with respect to the front surface and the back surface.

In another aspect of the invention, the spring clamp has a web portion adjacent the upper portion of the base and having an inner surface, a first curved finger extending from the web portion and having an inner surface, and a second curved finger extending from the web portion and having an inner surface, wherein the web portion's inner surface, the first finger's inner surface, and the second finger's inner surface define a substantially circular clamping area.

In another aspect of the invention, each of the inwardly curving fingers include an outwardly curving entry portion having an inner surface with the outwardly curving entry portions defining a throated entry for the clamping area.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

Figure 1:
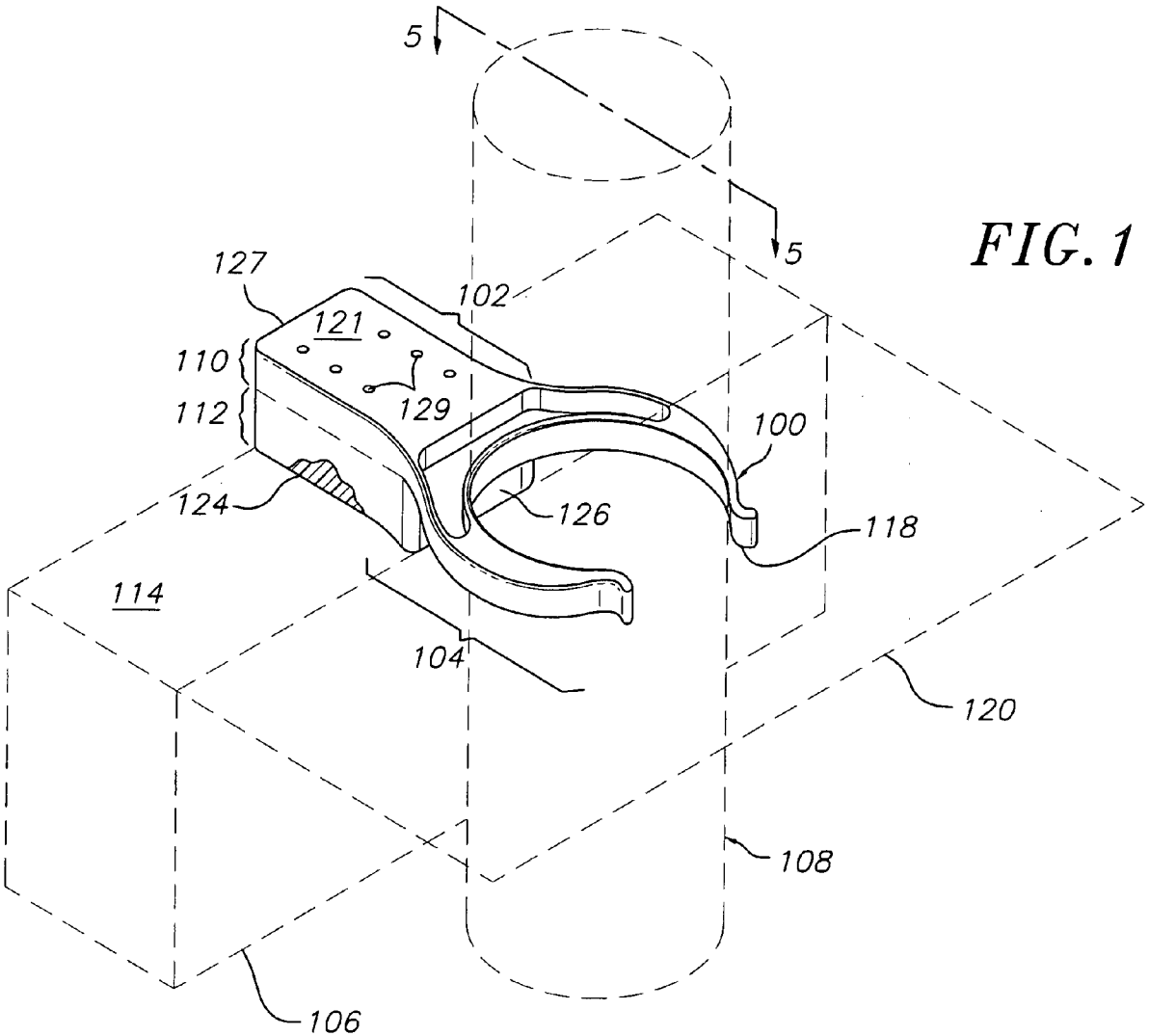
FIG. 1 is a perspective drawing of a piping clamp for a concrete form in accordance with an exemplary embodiment of the present invention shown in relation to a concrete form and a clamped pipe illustrated in broken lines.

FIG. 1 is a perspective drawing of a piping clamp for a concrete form in accordance with an exemplary embodiment of the present invention shown in relation to a concrete form and a clamped pipe illustrated in broken lines. For purposes of illustration, the piping clamp is herein described with reference to orthogonal vertical and a horizontal axes, it being understood that the piping clamp may be used in orientations other than that which is illustrated herein. A piping clamp 100 for a concrete form has a base 102 and a spring clamp 104 extending along a horizontal axis from the base 102. In use, the base 102 is fixedly attached to a concrete form 106 and the spring clamp 104 holds a pipe 108 in a spaced apart relationship to the concrete form 106.

The base 102 has a top portion 110 from which the spring clamp 104 extends horizontally and a lower standoff portion 112 extending along a vertical axis. The standoff portion 112 acts as a vertical spacer separating the top portion of the base 102 from a top surface 114 of the concrete form 106. As such, the standoff portion 112 also creates a vertical spaced apart relationship between a bottom surface 118 of the spring clamp 104 and a plane 120 defined by the top surface of the concrete form 106.

The base 102 further includes a top surface 121, a front surface 126, and a back surface 127. A plurality of fastener openings, such as fastener opening 129, may extend through the base 102. The plurality of fastener openings are distributed in a staggered and spaced apart manner between the front surface 126 of the base 102 and the back surface 127 of the base 102. In use, one or more fasteners are inserted through the fastener openings and into the top surface 114 of the concrete form 106, thus fixedly attaching the piping clamp to the top surface 114 of the concrete form 106.

Figure 2:
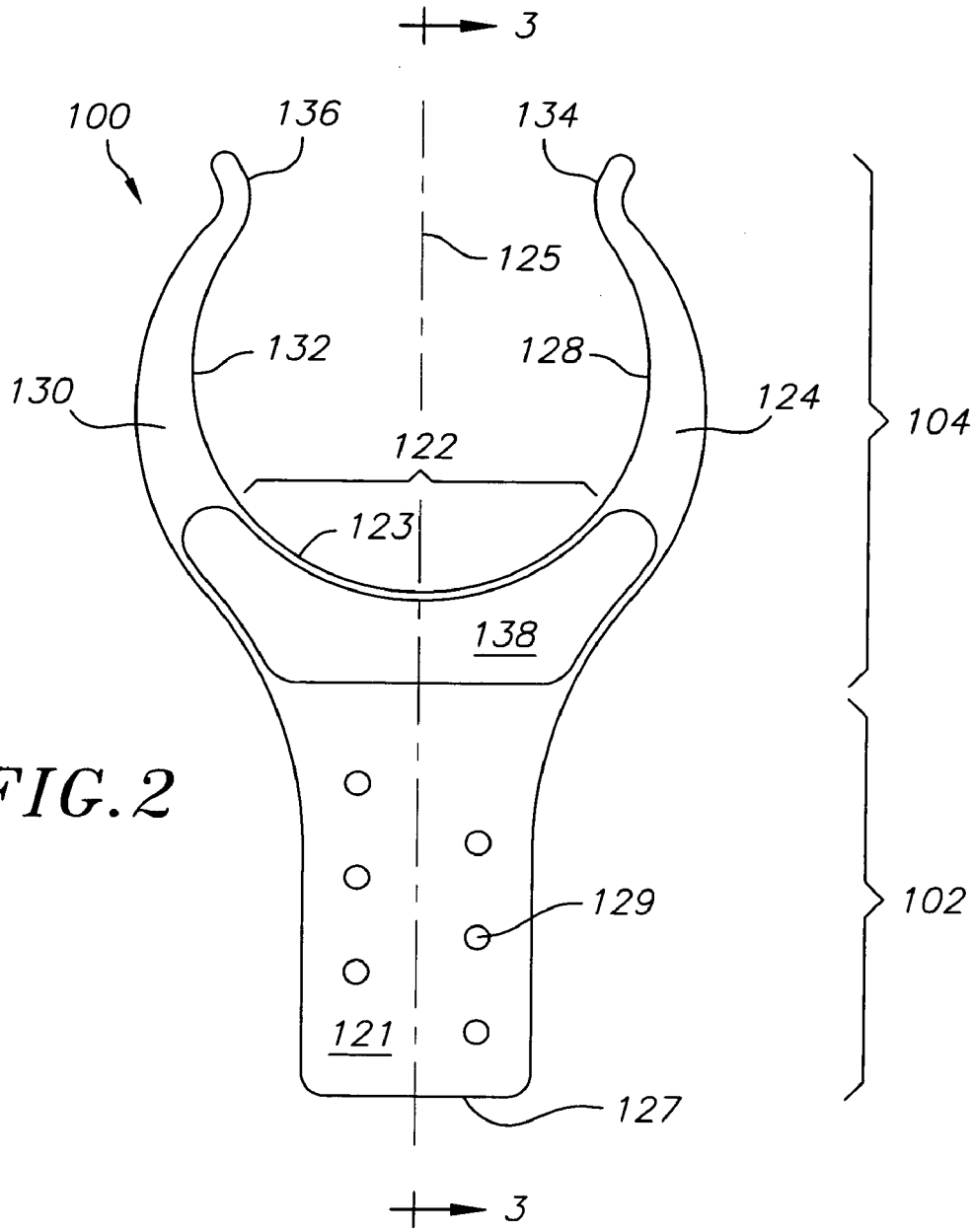
FIG. 2 is an enlarged top view of the piping clamp of FIG. 1.

FIG. 2 is an enlarged top view of the piping clamp of FIG. 1. A piping clamp for a concrete form 100 includes a base 102 and a spring clamp 104 extending from the base 102. The spring clamp 104 has a curved web portion 122 having an inner surface 123 with a first finger 124 extending from the web portion 122. The first finger 124 curves outwardly and then inwardly toward a central plane 125 of the piping clamp 100 and has an inner surface 128 facing the central plane 125. The spring clamp 104 also includes a second finger 130 extending from the web portion 122. The second finger 130 curves outward1ly and then inwardly toward a central plane 125 of the piping clamp 100 and has an inner surface 132 facing the central plane 125. The inner surface 123 of the web portion 122, the inner surface 128 of first finger 124, and the inner surface 132 second finger 130 define a clamping area having a substantially circular interior surface for coupling to a circular pipe.

The first finger 124 further includes a first entry portion 134 having an inner surface and curving outwardly away from the central plane 125. The second finger 130 further includes a second entry portion 136 having an inner surface and curving outwardly away from the central plane 125. The inner surface of the first entry portion and the inner surface of the second entry portion define a throated entry for the clamping area. In addition, the fingers are tapered, thinning in cross-section as they extend from the web portion 122 to their respective entry portions.

The web portion 122 may be relieved leaving a well 138 in the web portion 122 of the spring clamp 104. The dimensions of the web portion 122 and fingers may be altered in order to accommodate the outside diameters of different standard pipes.

As previously described, the base 102 of the piping clamp 100 may include a plurality of fastener openings, such as fastener opening 129, extending through the base 102. As shown, the plurality of fastener openings are distributed in a staggered and spaced apart manner alternating between a first side and a second side of the central plane 125. The plurality of fastener openings are distributed between the front surface 126 of the base 102 and the back surface 127 of the base. In alternative embodiments of the base 102, the fastener openings are omitted. In such embodiments, the fasteners pierce the material of the base 102 and create their own openings during an installation process.

In one piping clamp in accordance with an exemplary embodiment of the present invention, the length of the base 102 as measured from the front surface to the back surface is sized to accommodate 2X lumber commonly used in construction, namely the base is approximately two inches long as measured between the front surface 126 of the standoff portion 112 and the back surface 127 of the base. In addition, the plurality of fastener openings may be spaced apart at approximately quarter inch intervals allowing adjustment of the position of the piping clamp 100 relative to the top surface 114 of the concrete form 106.

Figure 3:
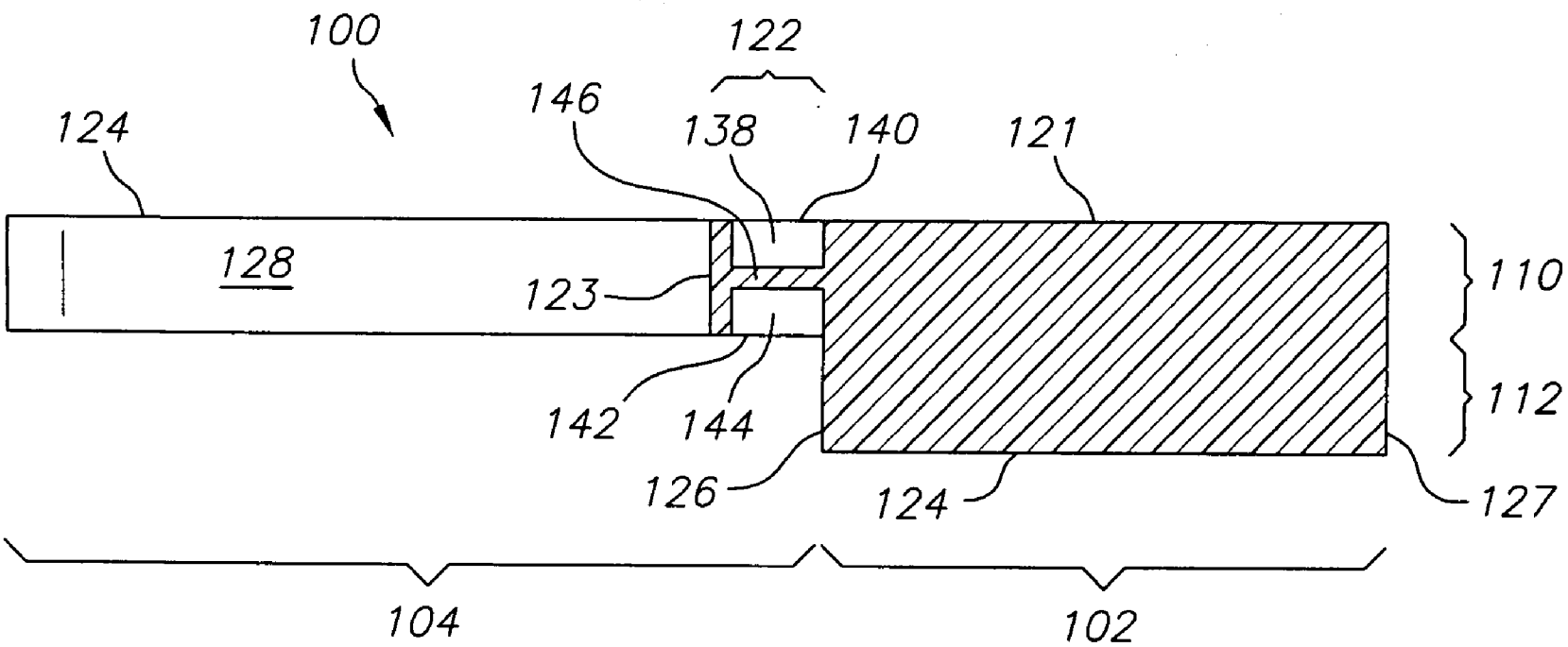
FIG. 3 is a vertical cross-sectional view of a piping clamp taken along the line 3—3 of FIG. 2.

FIG. 3 is a vertical cross-sectional view of a piping clamp taken along the line 3—3 of FIG. 2. In the cross-sectional view of the piping clamp, the first finger 124 is shown along with the first finger's inner surface 128. The web portion 122 of the spring clamp 104 includes a top surface 140 and a bottom surface 142. Recesses 138 and 144 extend from the top surface 140 of the web portion 122 and the bottom surface 142 respectively. The recesses extend into the web portion 122 but do not meet, leaving a wall 146 between the two recesses. In use, an outer surface of a pipe held in the spring clamp 104 abuts against an inner surface 123 of the web portion 122 with the outer surface of the pipe held in a spaced apart relationship to a front surface 126 of the standoff portion 112. In this configuration, the web portion 122 acts as a horizontal standoff extending from the front surface 126 of the standoff portion 112.

As previously described, the dimensions of the fingers of the spring clamp 104 may be varied in order to accommodate different sizes of the pipes to be clamped. However, the dimensions of the standoff portion 112, specifically the height, and the distance between the inner surface of the web portion 122 and the front face of the standoff portion 112 may be fixed regardless of the size of the pipe to be clamped. In piping clamps in accordance with various exemplary embodiments of the present invention, the height of the standoff portion 112 is approximately one-half inch. In addition, the distance between the inner surface of the web portion 122 and the front surface of the standoff portion 112 is approximately one-half inch.

Figure 4:
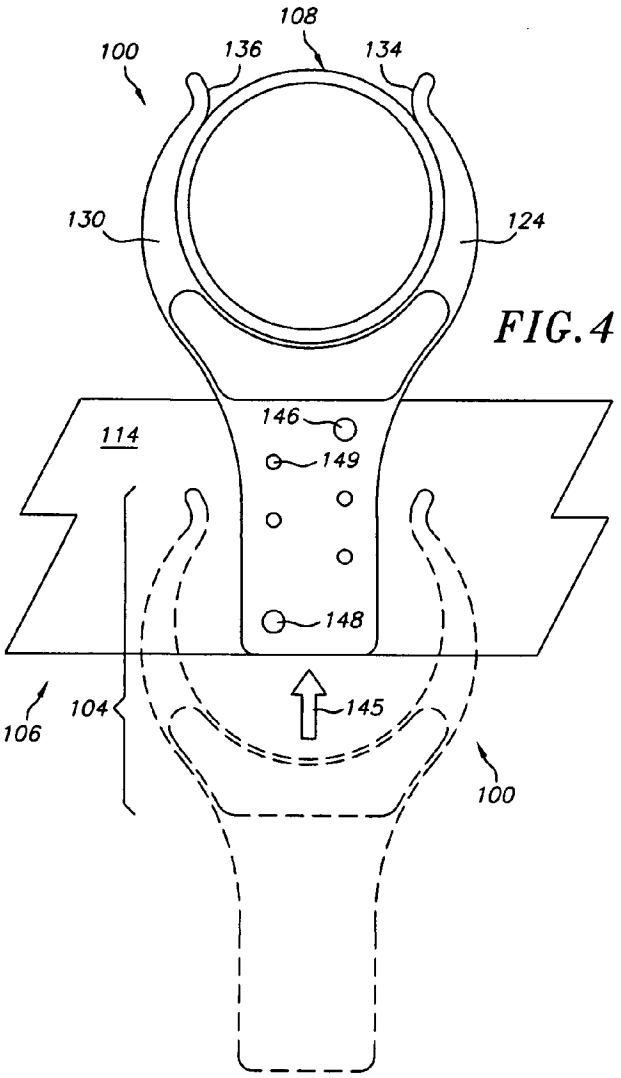
FIG. 4 is a diagram depicting installation of the piping clamp of FIG. 1.

FIG. 4 is a diagram depicting installation of the piping clamp of FIG. 1. The concrete form 106 is used to define a perimeter of a concrete structure, such as a concrete slab foundation, while the concrete is being poured and leveled. Generally, the concrete form 106 is put in place and piping, such as pipe 108, is routed as needed within the defined perimeter. The piping clamp 100 includes a spring clamp 104 having a throat defined by the first entry portion 134 of the first finger 124 and the second entry portion 136 of the second finger 130 of the spring clamp 104. Before the concrete is poured, the piping clamp 100 is removably attached to the pipe 108 by pushing (as indicated by arrow 145) the spring clamp 104 against the pipe 108 at the throat of the spring clamp 104 causing the pipe 108 to be inserted into the spring clamp 104 and grasped by the spring clamp's fingers. The piping clamp 100 is then secured at its base 102 to a top surface 114 of the concrete form 106 by one or more fasteners, such as fasteners 146 and 148, passing through one or more fastener openings, such as fastener opening 149.

Figure 5:
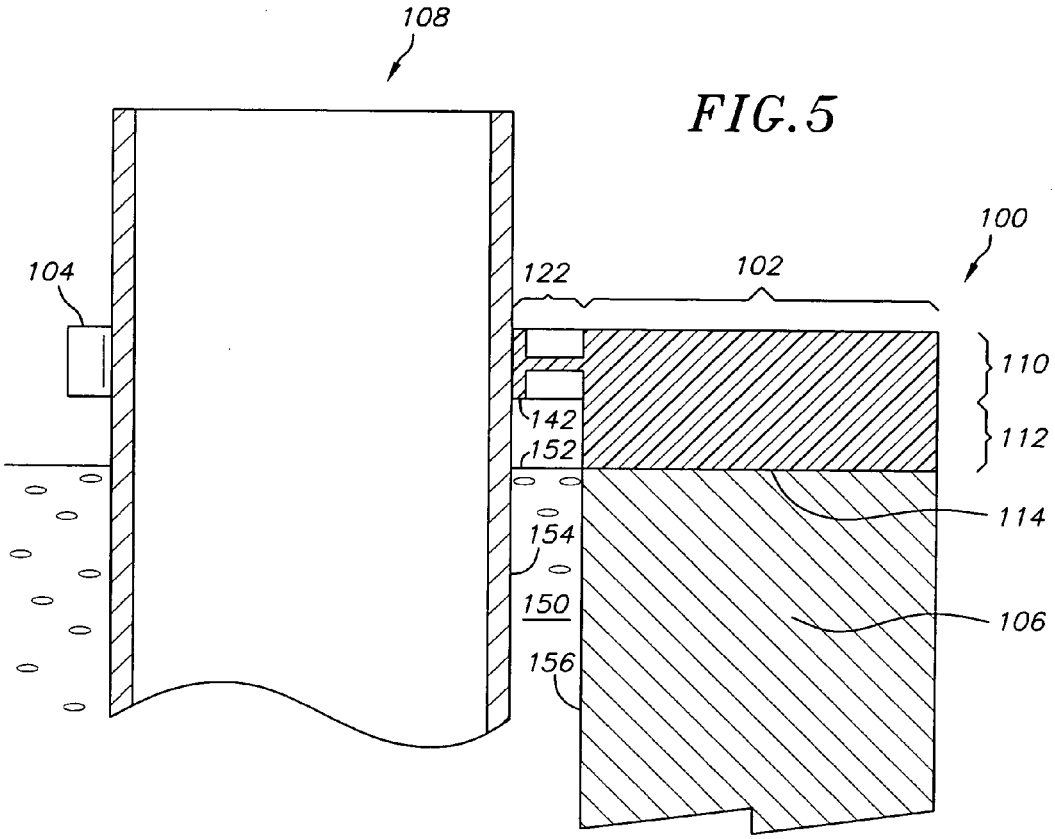
FIG. 5 is a cross-sectional view of the piping clamp in use taken along the line 5—5 of FIG. 1.

FIG. 5 is a cross-sectional view of the piping clamp in use taken along the line 5—5 of FIG. 1. The piping clamp 100 secures the pipe 108 to the concrete form 106 temporarily while concrete 150 is poured around the pipe. The piping clamp 100 includes a base 102 having a top portion 110 and a standoff portion 112. The base 102 is fixedly attached to a top surface 114 of the concrete form 106 by one or more fasteners (not shown). The spring clamp 104 extending horizontally from the top of the base 102 is removably attached to the pipe 108, thus attaching the pipe to the concrete form 106 via the base in a removable manner. Since the spring clamp 104 extends from the top portion 110 of the base 102, the standoff portion 112 holds the spring clamp in a spaced apart relationship between a bottom surface 142 of the spring clamp and a top surface 152 of the concrete. This spaced apart relationship allows workers to trowel the top surface of the concrete in an area that would have normally been occluded by the spring clamp 104 if it where not held above the top surface 152 of the concrete 150.

In addition, the web portion 122 of the spring clamp 104 functions as a horizontal standoff holding the pipe 108 such that an exterior surface 154 of the pipe is held in a spaced apart relationship with an interior surface 156 of the concrete form 106. This spaced apart relationship allows concrete to completely surround the exterior surface 154 of the clamped pipe 108 when the concrete 150 is poured.

Figure 6:
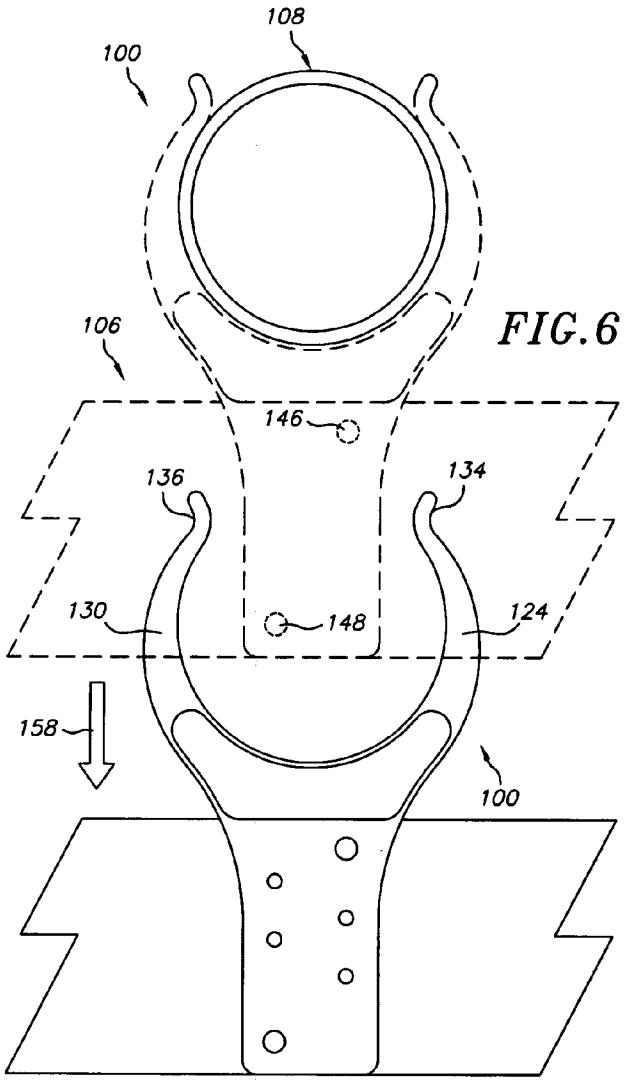
FIG. 6 is a diagram depicting removal of ef. the piping clamp of FIG. 1.

FIG. 6 is a diagram depicting removal of the piping clamp of FIG. 1. Once the concrete has been poured, surfaced, and allowed to harden, the concrete form 106 defining the perimeter of the poured concrete structure is separated from the hardened concrete. As the piping clamp 100 is fixedly attached to the concrete form 106 by one or more fasteners, such as fasteners 146 and 148, separating the concrete form 106 from the hardened concrete (as indicated by arrow 158) also separates the piping clamp from the pipe 108 to which the piping clamp is removably attached. The pipe 108 is removed by forcing the pipe to pass through a throat of the piping clamp 100 defined by the first entry portion 134 of the first finger 124 and the second entry portion 136 of the second finger 130.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supportable by this application and the claims' equivalents.

What is claimed is:

1. A piping clamp for locating a pipe relative to a concrete form, comprising:

a base comprising:

an upper portion, a standoff portion having a lower surface for attachment to an upper surface of the concrete form, and a plurality of fastener openings in the base extending at least partially from an upper surface of the upper portion of the base to the lower surface of the standoff portion of the base; and a spring clamp for engagement with a pipe in a clamping relationship, the spring clamp extending from the upper portion of the base at a position vertically offset from the lower surface of the standoff portion of the base.

2. The piping clamp of claim 1, wherein the base further comprises a front surface and a back surface, wherein the plurality of fastener openings are staggered in a spaced apart relationship with respect to the front surface and the back surface of the base.

3. The piping clamp of claim 1, wherein the spring clamp further comprises:

a web portion adjacent the upper portion of the base and having an inner surface;

a first curved finger extending from the web portion and having an inner surface;

a second curved finger extending from the web portion and having an inner surface;

wherein the web portion's inner surface, the first finger's inner surface, and the second finger's inner surface together define a substantially circular clamping area for receiving the pipe.

4. The piping clamp of claim 3, wherein the first curved finger and the second curved finger further comprise a first entry portion having an inner surface and a second entry portion having an inner surface, respectively, the inner surface of the first entry portion and the inner surface of the second entry portion together defining a throated entry for the clamping area.

5. The piping clamp of claim 1, wherein the spring clamp comprises an inner surface capable of clampingly receiving the pipe, and which is horizontally offset from a front surface of the standoff portion of the base.

6. The piping clamp of claim 3, wherein the inner surface of the web portion is horizontally offset from a front surface of the standoff portion of the base.

7. The piping clamp of claim 1, wherein an upper surface of the spring clamp comprises a recessed area.

8. The piping clamp of claim 3, wherein an upper surface of the web portion comprises a recessed area.

9. A piping clamp for locating a pipe relative to a concrete form, comprising:

a base comprising:

an upper portion, and a standoff portion having a lower surface for attachment to an upper surface of the concrete form;

a spring clamp having an inner surface for removably clampingly receiving the pipe, wherein the inner surface of the spring clamp is vertically offset from the lower surface of the standoff portion of the base, and wherein the inner surface of the spring clamp is horizontally offset from an inner surface of the standoff portion of the base; and a plurality of fastener openings in the base extending at least partially from an upper surface of the upper portion of the base to the lower surface of the standoff portion of the base.

10. The piping clamp of claim 9, wherein the spring clamp further comprises:

a web portion adjacent to the upper portion of the base and having an inner surface;

a first curved finger extending from the web portion and having an inner surface;

a second curved finger extending from the web portion and having an inner surface; and an open end between the first and second fingers, opposite the web portion, wherein the inner surfaces of the web portion and the first and second fingers combine to define the inner surface of the spring clamp.

11. The piping clamp of claim 9, wherein an upper surface of the spring clamp comprises a recessed area adjacent to the inner surface of the spring clamp.

12. The piping clamp of claim 10, wherein an upper surface of the web portion comprises a recessed area.

13. The piping clamp of claim 8 wherein the fastener openings extend through the base from the upper surface of the upper portion of the base to the lower surface of the standoff portion of the base.

14. The piping clamp of claim 12 wherein the fastener openings extend through the base from the upper surface of the upper portion of the base to the lower surface of the standoff portion of the base.

* * * * *